United States Patent [19]

Clarke

[11] Patent Number: 4,634,310

[45] Date of Patent: Jan. 6, 1987

[54] TRAFFIC MARKER AND HOUSING

[76] Inventor: Ronald A. W. Clarke, 501 Wilkins Street, Apt. 717, London, Ontario, Canada, N6C 5G2

[21] Appl. No.: 700,874

[22] Filed: Feb. 12, 1985

[30] Foreign Application Priority Data

Feb. 14, 1984 [CA] Canada ..... 447389

[51] Int. Cl.[4] ..... E01F 9/00

[52] U.S. Cl. ..... 404/15; 404/16

[58] Field of Search ..... 404/6, 8, 9, 11, 12, 404/13, 14, 7, 10, 15, 16; 40/612; 116/63 R; 350/97, 103; 248/346, 519, 677

[56] References Cited

U.S. PATENT DOCUMENTS

| | | | |
|---|---|---|---|
| 3,570,377 | 3/1971 | Gerber | 404/11 |
| 3,587,416 | 6/1971 | Flanagan | 404/9 |
| 3,971,623 | 7/1976 | Hedgewick et al. | 404/11 |
| 3,975,108 | 8/1976 | Suhr et al. | 404/16 |
| 4,402,627 | 9/1983 | Schwab et al. | 404/15 |

*Primary Examiner*—James A. Leppink
*Assistant Examiner*—Matthew Smith

[57] ABSTRACT

A traffic marker and housing is disclosed, intended for installation in a road surface to provide delineation of traffic lanes. The marker comprises a platform installed flush with the road surface, with two bridges projecting upwardly from the platform, the bridges including ramp portions, and a reflector carried between the bridges in protected fashion. The platform extends beyond the ends of the bridges. The two bridges are aligned with the direction of traffic flow and offset from each other by an angle corresponding to the angle presented by an oncoming snowplow blade, so that the snowplow blade impacts both substantially simultaneously. The ramp portions are coplanar, and the plane of the ramp portions is offset by the same angle as the bridges. Apertures in the bridges provide an automatic cleaning feature, produced by the effect of passing vehicles. The bridges have angled outside edges to minimize inconvenience to traffic.

5 Claims, 10 Drawing Figures

TRAFFIC MARKER AND HOUSING

BACKGROUND OF THE INVENTION

This invention relates to road-imbedded traffic markers and their housings, including especially traffic markers embodying reflectors.

Traffic markers are installed in roads for the purpose of providing positive visual identification or delineation of the various traffic lanes at night, which is especially useful in wet or foggy conditions. Traffic lanes are usually defined by lines painted on the road surface, but in wet weather conditions the painted lines often become quite indiscernable, because of the deflection of the vehicles' headlight beams away from their source. To resolve this problem, reflectors are installed, with reflective surfaces protruding above the water film covering the road surface. When there are heavy snowfalls, the lines may become covered with snow. Road-imbedded traffic markers project slightly above the road surface and thus reduce or eliminate the problem, especially when embodying reflective elements.

Generally, road markers are positioned in line with the lines painted on the road surface, so that the lanes are thus clearly delineated. In addition, since the noise and vibration produced from driving over the markers deters drivers from doing so, there is then reduced wear on the painted markings, reducing the need for frequent repainting.

However, there are a number of problems associated with designing suitable traffic markers, especially in areas where snowfalls commonly occur. Any traffic marker must be able to stand up to repeated impacts from vehicle tires. In the case of traffic markers in snowfall areas, the markers must also be able to withstand the impact of snow removal equipment, especially snowplow blades, and at the same time must not unduly impede snow removal or produce excessive wear or damage to snowplow blades. The marker housing itself must be able to withstand impact, and the reflector should be protected to avoid separation from the housing, which has been a problem in the prior art.

Also, a traffic marker should preferably support its reflective surface or surfaces at approximately ninety degrees to the light source, i.e. approximately vertically. If the surface is angled, some light is inevitably reflected away from the source rather than back towards it, reducing the brilliance of the return signal and thus the effectiveness of the marker. There must also be some means by which the reflective surfaces are kept relatively clean, so that their reflective properties are preserved. In the case of a vertical reflective surface, this is particularly difficult to accomplish since road debris tends to pile up and accumulate against the surface. A reflective surface with an angled face is to some extent cleaned by the action of vehicles' wheels passing over it.

In some traffic markers in the prior art, cleaning of the reflective surfaces has been accomplished by providing for vertical movement of components when impacted, to wipe the reflective surfaces. Vertical movement has also been employed in the prior art to protect the markers by having them recede towards or beneath the road surface on impact, such markers being referred to as being "retractable".

Ideally the traffic markers should not be too complicated or expensive to manufacture, in view of the large quantities required. Retractable markers are obviously somewhat complicated in design. The markers should also be relatively simple to install in the road surface. Simplicity of installation is important not only from a cost viewpoint, but also in view of the need to minimize disruption to traffic during installation.

SUMMARY OF THE INVENTION

In view of the above problems, it is an object of the present invention to provide an improved traffic marker and housing.

Thus in accordance with the present invention there is provided a traffic marker housing which is plowable, which protects and supports a reflector or reflectors, and which in its preferred embodiment provides for automatic cleaning of the reflector or reflectors. The marker is relatively simple in design, and is relatively simple to install.

As will be described in greater detail later herein, the marker housing comprises a platform for installation at the level of the road surface, with two bridges projecting upwardly from the platform and a reflector carried between the bridges. The bridges are shaped to approximately complement the shape presented by an oncoming snowplow blade, which contacts the bridges and rides over them and thus above the reflector.

In accordance with the automatic reflector cleaning feature of the invention, an outlet is provided adjacent to each reflector through a bridge. The opening operates in the manner described later herein to provide an automatic cleaning action when vehicles pass by.

Other features of the invention will become apparent in the following detailed description of the preferred and alternative embodiments.

BRIEF DESCRIPTION OF THE DRAWINGS

Reference will be made to the accompanying drawings, in which:

FIG. 6 is a side elevation of an alternative embodiment, intended for one-way traffic;

FIG. 7 is a plan view of the alternative embodiment;

FIG. 8 is a side elevation of the marker, showing an alternate anchoring means for the marker housing;

FIG. 9 is an end elevation of the marker, also showing the alternate anchoring means; and FIG. 10 is a drawing of a reflector holder.

DETAILED DESCRIPTION OF THE PREFERRED EMBODIMENT

Figure 1:
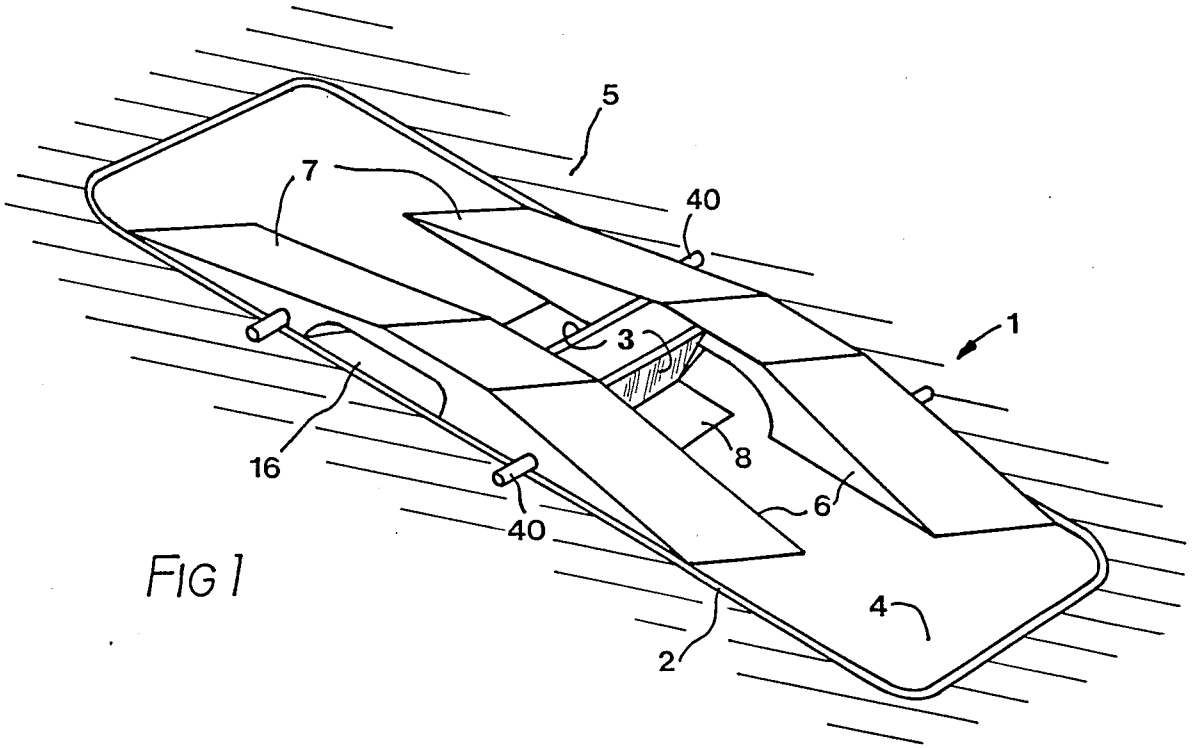
FIG. 1 is a perspective, showing the preferred embodiment of the traffic marker mounted in a road surface, and showing locating dowels used in the installation of the marker but removed after installation.

Referring now to FIG. 1, the preferred embodiment of the traffic marker of the present invention is illustrated. The marker 1 consists essentially of a housing 2 and reflectors 3, one facing each traffic direction. The housing 2 comprises a platform 4 and two bridges 6 running parallel to the traffic flow. The reflectors are mounted vertically in the housing, for optimum reflection, and the marker is fixed rather than retractable, offering relative simplicity. As will be explained in more detail herein, the reflectors are essentially selfcleaning, despite its vertical orientation and the absence of moving parts.

The preferred embodiment is intended for two-way traffic. Thus the bridges have ramp portions 7 in both traffic directions, and two reflectors (or a single two-sided reflector). The marker is reversible, i.e. it may be oriented in either direction, unless of course it is desired to have different reflector signals (i.e. different colours) sent in different directions.

The platform 4 is installed, in the manner described later herein, with its upper surface essentially flush with the road surface 5. The bridges 6 project above the road surface, as do the reflectors 3 which are mounted vertically and centrally between the bridges.

The type of reflector 3 is not in itself important to the present invention, nor is the means by which the reflectors are mounted between the bridges. Any suitable reflector may be employed, and any suitable mounting means may be employed. In the preferred embodiment of the present invention, the reflector is a Stimsonite (trademark) reflector, manufactured and sold by the Signal Products Division of Amerace Corporation. As illustrated in FIG. 10, two such reflectors 3 are bonded into a reflector holder 8, with one reflector facing each direction. The bottom surface 11 of the reflector holder is in turn bonded to the marker platform 4, the platform being provided with a recess 13 to accommodate the holder.

Alternatively, a Stimsonite 944 (trademark) reflector having angled faces may be used. The bottom surface of this reflector fits within the recess 13 and is there bonded to the platform. The automatic cleaning feature described later herein is inoperative when such a reflector is used, but as mentioned earlier angled-face reflectors are to some extent automatically cleaned by vehicle tire action.

The main purpose of the bridges is to lift the blade of a snowplow when the blade impacts the marker, so that the blade does not come into contact with the reflector. The bridges are designed to provide optimum performance under typical snowplowing conditions, which are as follows:

a. Snowplowing speed: less than 70 kilometers per hour;
b. Blade mass: Approximately 2400 pounds or 1100 kilograms;
c. Angle of blade to direction of travel: approximately 55 degrees;
d. Angle of blade from road surface: approximately 55 degrees;
e. Blade leading edge material: tungsten carbide.

In view of the above parameters, the shape of the bridges is somewhat complex, being designed to complement the shape presented by a passing snowplow blade, whether passing from one direction or the other. For convenience and clarity, the bridge design will now be described with reference to one end or half of the marker only, the other end or half being identical. FIGS. 2, 3, 4 and 5 most clearly illustrate the bridge design.

The bridges 6 are offset from each other at an angle B of 55 degrees from the centre line of the marker, to correspond to the usual snowplow blade angle. When a snowplow blade impacts the marker, the first point of contact is the bridges, since they project above the road surface. Because the bridges are offset at 55 degrees, the snowplow blade impacts both bridges virtually simultaneously. The ramp portions 7 of the bridges are coplanar, and the plane of the ramps is also offset by 55 degrees, so a passing snowplow blade contacts planar surfaces of both bridges. The shock load is thus fairly evenly distributed, and a relatively large surface area is presented to the snowplow blade, thereby reducing the pressure.

The ramp portions 7 rise from the platform at a suitably small angle, such as 5 degrees. Obviously, too large an angle produces too violent an impact with passing snowplow blades, while too small an angle produces a marker which is longer than necessary (and therefore more expensive to manufacture and install).

The ramp portions 7 of the bridges 6 do not start at the leading edge 10 of the platform 4. In designs where bridges do start at the leading edges of the platform, the force of the snowplow blade impact acting relatively near the edge of the platform tends to produce excessive flexing of the platform, frequently causing the grout bond by which the marker is held in the road surface to fail. In the present design, with the initial snowplow blade impact point being more central (averaging roughly one sixth of the length of the platform in from the leading edge of the platform), there is less flexing of the platform, and the grout bond is accordingly not so prone to failure. Another result of this extended leading edge of the platform is of course that a larger surface area is provided for bonding the housing to the road surface substrate, thus improving the strength of the bond.

Figure 3:
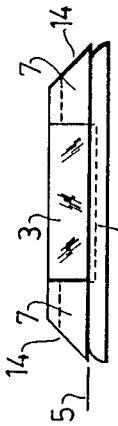
FIG. 3 is an end elevation of the marker.

As can be seen most clearly from FIG. 3, the outside edges 14 of the bridges 6 are angled at 45 degrees. These angled edges are provided to minimize the obstruction and inconvenience to vehicular traffic under ordinary weather conditions. The geometry of the arrangement is such that the bridges present their maximum width to the snowplow blade at the crucial point of initial contact, becoming narrower due to the angled edges 14 as their height increases.

The dimensions of the marker are of course not critical, and may be varied considerably within the scope of the invention. However, it has been found to be convenient to have the overall platform dimensions to be about 14½ inches long by 4 inches wide (36.8 cm. by 10 cm.), with the top of the bridges projecting about ½ inch (1.25 cm.) above the road surface.

The material preferably used for the construction of the marker housing is a foundry zinc alloy, although any suitably strong material could be used.

The bridges 6 are each provided with an outlet 16 centrally located adjacent to each reflector 3 and the upper surface of the platform 4, by which water and other matter may escape from the platform. The outlet for each reflector is through the bridge on the side of the traffic facing that reflector. These outlets provide the previously-mentioned automatic cleaning of the reflectors. In wet weather, the wheel of an approaching vehicle sends out a bow wave of water which enters the platform between the bridges. The water is trapped between the bridges, and swirls in turbulent fashion against the face of the reflector 3, thus cleaning the reflector. The water then escapes via the outlet, being aided in doing so by the partial vacuum created in the wake of the passing vehicle.

In dry conditions, the same action prevents dust and other debris from accumulating against the reflector face.

FIGS. 6 and 7 illustrate an alternative embodiment, intended for one-way traffic (although the preferred embodiment could of course also be used for one-way traffic). As can be seen from the drawings, all of the same features are employed, but only one reflector direction is accommodated. The ramp portions 7 of the bridges at one end or half of the marker, instead of continuing into ramp portions for another half of the marker, terminate at an angled rear surface 12 of the housing. The preferred embodiment can be seen as two identical traffic marker "sections" abutting each other and facing in opposite directions, with the alternative embodiment being a singled marker section.

To install the marker in the road surface, a recess is excavated to accommodate the marker housing, the recess preferably being no larger than necessary to just accommodate the marker. A cutting machine of the type described in U.S. Pat. No. 3,904,245, invented by the present inventor and known as a reflex percussive cutting machine, may be used, or any other suitable means may be employed. A small measured quantity of hot bitumen or other suitable sealant adhesive is then poured into the recess to act as a grout. A marker is then inserted in the recess, locating dowels 40 having first been inserted in dowel-receiving holes 42 provided in the outer sides of the bridges 6. The dowels support the marker at the proper height relative to the road surface while the grout is allowed to set properly. Once the grout has set, the dowels are removed, and then traffic may be allowed.

Figure 5:
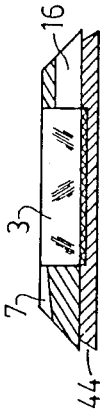
FIG. 5 is a sectional drawing along the line A—A of FIG. 4.
Figure 2:
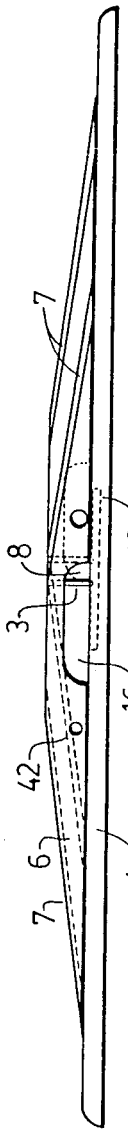
FIG. 2 is a side elevation of the marker.
Figure 4:
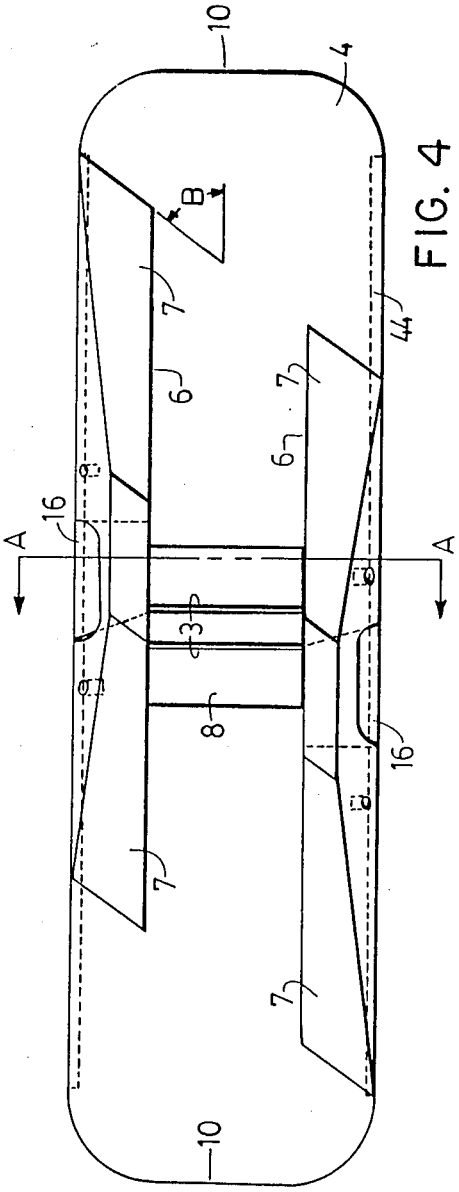
FIG. 4 is a plan view of the marker.

As seen most clearly in FIG. 5, the platform 4 has angled side edges 44, angled inwardly at 30 degrees from the vertical to aid in anchoring the platform in the grout. As illustrated in FIGS. 8 and 9, an alternate construction for the bottom of the platform may instead be used, in which rows of angled tongues 46 project downwardly to aid in anchoring the platform in the grout. The exact anchoring means used is of course not essential to the invention.

It will be appreciated that the above description of the preferred and alternative embodiments is by way of example only. A number of variations would be obvious to those skilled in the art, and would still clearly be within the broad scope and spirit of the invention, whether or not expressly described and claimed.

For example, it should be apparent that the above description relates to a traffic marker for use in countries where vehicles drive on the right hand side of the road. In countries where vehicles drive on the left, the marker configuration would be a mirror image of that described above.

Furthermore it should be apparent that the 55 degree bridge offset angle was selected to match the typical angle of a snowplow blade from the direction of traffic. In areas where different snowplow blade angles are more common, a person skilled in the art could readily adjust the design to a more suitable angle.

What is claimed as the invention is:

1. Traffic marker, having a reflector which reflects light from the headlamps of an oncoming vehicle back towards the vehicle;

where a longitudinal axis of the marker lies parallel to the direction of the traffic;

where the marker comprises a ramp-surface;

where the ramp surface is so positioned on the marker that an oncoming snow-plow blade will strike the ramp-surface;

where the ramp-surface slopes gently upwards in such a manner that the said snow-plow blade, upon striking the ramp-surface, will be deflected gently up and over the marker;

and where the ramp surface also slopes laterally, at a substantial angle to the longitudinal axis of the marker.

2. Marker of claim 1, where the said substantial angle is about 55 degrees.

3. Marker of claim 1, where the ramp surface is in two portions, and where the reflector lies between the two portions.

4. Marker of claim 1, where the marker includes a platform, and where the ramp surface is so arranged on the marker that the ramp surface slopes upwards from the platform.

5. Marker of claim 4, where the platform extends forwards beyond the ramp-surface, whereby an oncoming snow-plow blade is a substantial distance onto the platform before striking the ramp-surface.

* * * * *